US009839286B2

(12) United States Patent
Chuang et al.

(10) Patent No.: US 9,839,286 B2
(45) Date of Patent: Dec. 12, 2017

(54) FOLD-OUT CABINET ASSEMBLY

(71) Applicant: Trinity International Industries, LLC, Carson, CA (US)

(72) Inventors: Luke Chuang, Shanghai (CN); Cze-Chao Tam, Palos Verdes, CA (US); Hong Fu, Shanghai (CN); Yuliang Li, Shanghai (CN)

(73) Assignee: Trinity International Industries, LLC, Carson, CA (US)

( * ) Notice: Subject to any disclaimer, the term of this patent is extended or adjusted under 35 U.S.C. 154(b) by 0 days.

(21) Appl. No.: 15/441,083

(22) Filed: Feb. 23, 2017

(65) Prior Publication Data

US 2017/0156492 A1 Jun. 8, 2017

Related U.S. Application Data

(63) Continuation of application No. 15/138,938, filed on Apr. 26, 2016, now Pat. No. 9,622,573.

(60) Provisional application No. 62/161,533, filed on May 14, 2015.

(51) Int. Cl.

| | |
|---|---|
| ***A47B 47/00*** | (2006.01) |
| ***A47B 43/00*** | (2006.01) |
| ***E05D 7/08*** | (2006.01) |
| ***A47B 96/02*** | (2006.01) |
| ***A47B 88/00*** | (2017.01) |

(52) U.S. Cl.

CPC ..... *A47B 43/00* (2013.01); *A47B 47/0075* (2013.01); *A47B 88/00* (2013.01); *A47B 96/02* (2013.01); *E05D 7/08* (2013.01)

(58) Field of Classification Search

CPC ..... A47B 43/00; A47B 47/0075; A47B 96/02; A47B 88/04; A47B 88/00; E05Y 2900/20; E05D 7/08

See application file for complete search history.

(56) References Cited

U.S. PATENT DOCUMENTS

| | | | | |
|---|---|---|---|---|
| 2,552,380 A * | 5/1951 | Pickell | A47B 83/045 | 190/12 R |
| 2,649,350 A * | 8/1953 | Backus | A47B 43/02 | 312/258 |
| 3,166,367 A * | 1/1965 | Vincens | E05D 7/1016 | 16/229 |
| 4,703,981 A * | 11/1987 | Stewart | A47B 43/00 | 217/48 |

(Continued)

FOREIGN PATENT DOCUMENTS

GB 2121679 A * 1/1984 ..... A47B 43/00

*Primary Examiner* — Hanh V Tran

(74) *Attorney, Agent, or Firm* — Innovation Capital Law Group, LLP; Vic Lin

(57) ABSTRACT

A fold-out cabinet includes a folding back panel that is pivotably attached to side panels so that the back panel can be sandwiched at least partially between the side panels when in a folded configuration. When unfolded, top and bottom panels are attached to complete the cabinet structure. The fold-out cabinet can be rapidly assembled and takes up a minimal footprint when packaged for storage, shipping or merchandising. Optional accessories may be included with the cabinet, including a workbench type top surface, one or more shelves, one or more drawers, and one or more doors. When assembled, the cabinet is structurally stable and functional, but requires little time for complete assembly.

19 Claims, 10 Drawing Sheets

(56) References Cited

U.S. PATENT DOCUMENTS

| | | | | | |
|---|---|---|---|---|---|
| 5,570,940 | A * | 11/1996 | Maro | E06B 5/006 | 312/257.1 |
| 5,593,046 | A * | 1/1997 | Katsuura | H05K 7/1424 | 211/162 |
| 6,000,771 | A * | 12/1999 | Wissinger | E05D 15/505 | 312/401 |
| 6,712,434 | B2 * | 3/2004 | Knab | H02B 1/38 | 16/225 |
| 6,848,758 | B1 * | 2/2005 | Yeh | F16B 12/24 | 312/257.1 |
| 7,118,185 | B2 * | 10/2006 | Mittag | A47B 47/02 | 312/326 |
| 7,772,489 | B2 * | 8/2010 | Adducci | H02B 1/202 | 174/17 R |
| 2003/0085640 | A1 * | 5/2003 | Chan | A47B 43/00 | 312/262 |
| 2008/0084149 | A1 * | 4/2008 | Ho | A47B 47/042 | 312/258 |
| 2008/0100188 | A1 * | 5/2008 | LeTourneau | A47B 43/00 | 312/258 |
| 2013/0127316 | A1 * | 5/2013 | Wu | A47B 88/9416 | 312/258 |

* cited by examiner

FOLD-OUT CABINET ASSEMBLY

CROSS-REFERENCE TO RELATED APPLICATIONS

This application is a continuation application of U.S. patent application Ser. No. 15/138,938, filed Apr. 26, 2016, currently pending, the contents of which are herein incorporated by reference which is the Non-Provisional of U.S. Provisional Patent Application Ser. No. 62/161,533 filed on May 14, 2015, the disclosure of which is incorporated by reference herein.

BACKGROUND OF THE INVENTION

1. Field of the Invention

The invention relates generally to cabinets, and more particularly to a fold-out cabinet that allows for rapid and simple assembly while providing a reduced pre-assembled footprint for storage, shipping and merchandising.

2. Description of Prior Art and Related Information

Many conventional cabinets are manufactured in their fully or partially assembled state, where the footprint of the cabinet offered for sale is the same as the footprint of the installed cabinet. While this pre-assembled manufactured cabinet results in minimal effort prior to installation, the shipping, storage and merchandising of such cabinets requires substantial space.

As a solution to the above, several companies began to offer ready-to-assemble (RTA) cabinets. These cabinets are provided in a relatively flat box where the sides, back and bottom are joined together by the user prior to installation. This approach does help reduce the packaging size, but also requires a significant time input for the assembly of the cabinet. Moreover, these cabinets are usually completely disassembled, requiring attachment all components together, taking significant time and effort.

However, even with a ready-to-assemble cabinet, the back panel is often the largest component. Thus, the packaging required for shipping and storage of the cabinet must be as large as the back panel. Many times, shipping rates are based on the overall package dimensions. Therefore, when large back panels are involved, the overall package dimensions can be quite large.

As can be see, there is a need for a cabinet that can be easy to assemble while occupying a relatively small packaging, shipping and merchandising volume.

SUMMARY OF THE INVENTION

It is one aspect of the present invention to provide a fold-out cabinet comprising a back panel; first and second side panels pivotably attached along first and second pivot axes to opposing ends of the back panel; and one or more pivoting connections formed in the back panel, the pivoting connections permitting the back panel to fold.

Another aspect of the present invention is to provide a fold-out cabinet comprising a back panel; first and second side panels pivotably attached along first and second pivot axes to opposing ends of the back panel; one or more pivoting connections formed in the back panel, the pivoting connections permitting the back panel to fold, the pivoting connections having a back panel pivot axis substantially parallel to the first and second pivot axes; a top panel attached to a top edge of the first and second side panels and the back panel; and a bottom panel attached to a bottom edge of the first and second side panels and the back panel, wherein the first and second side panels sandwich the back panel therebetween when the fold-out cabinet is in a folded configuration.

According to some aspects of the present invention, optional features may be included with the fold-out cabinet. These optional include one or more doors, one or more shelves, one or more doors, a workbench type top panel, or combinations thereof.

An additional aspect of the present invention is to provide a method for assembling a cabinet, comprising pivoting, along a first pivot axis, a first side panel to a 90 degree angle relative to a back panel; pivoting, along a second pivot axis, a second side panel to a 90 degree angle relative to a back panel; straightening a back panel by unfolding the back panel along a third pivot axis; attaching a top panel to a top edge of the first side panel, the second side panel and the back panel; and attaching a bottom panel to a bottom edge of the first side panel, the second side panel and the back panel.

The methods may further include positioning the various optional features into the cabinet structure, such as one or more doors, one or more shelves, one or more doors, a workbench type top panel, or combinations thereof.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
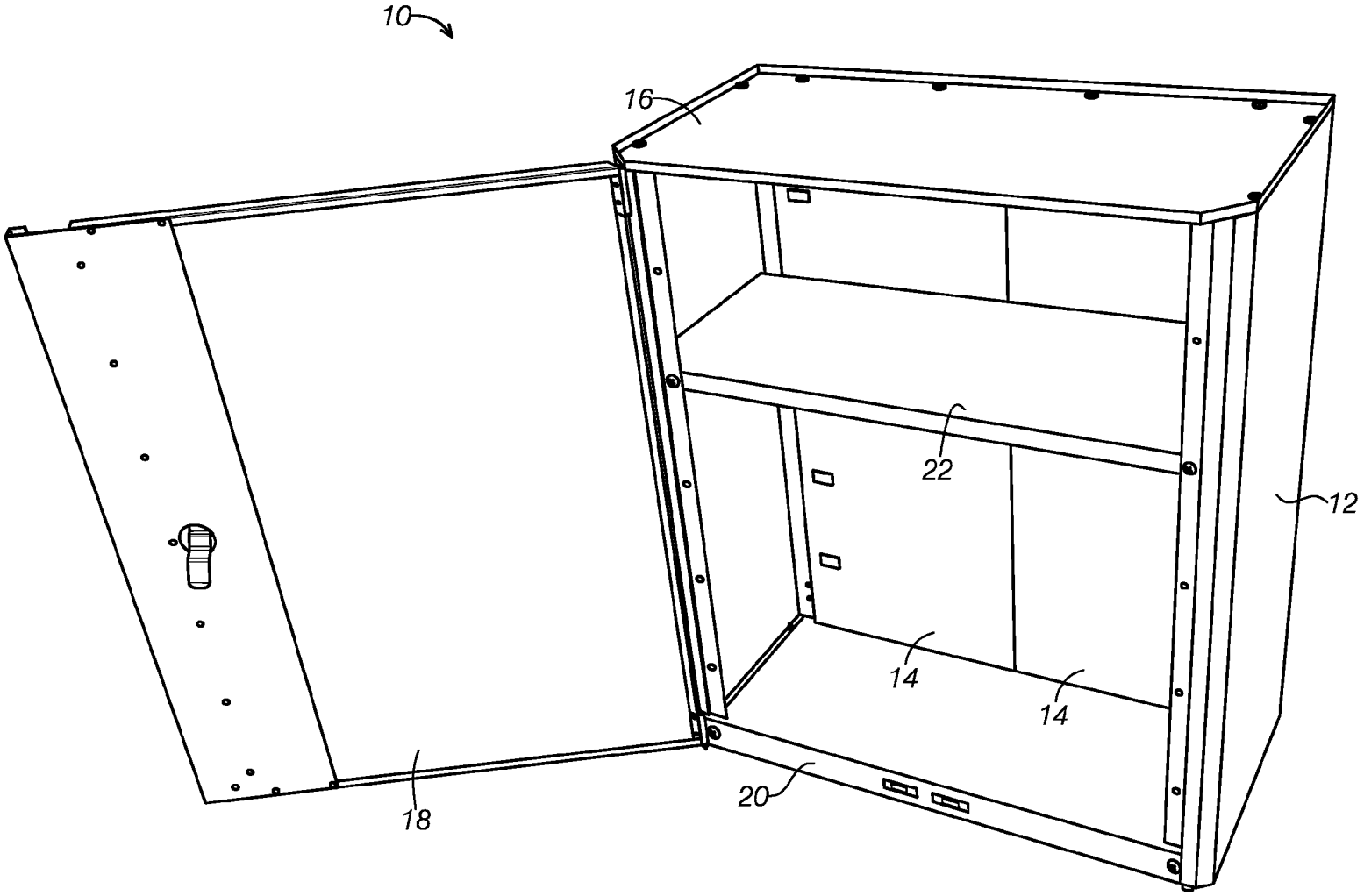
FIG. 1 shows a front perspective view of a fold-out cabinet according to an exemplary embodiment of the present invention.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Broadly, the present invention provides a fold-out cabinet that can include a folding back panel that is pivotably attached to side panels so that the back panel can be sandwiched at least partially between the side panels when in a folded configuration. When unfolded, top and bottom panels are attached to complete the cabinet structure. The fold-out cabinet can be rapidly assembled and takes up a minimal footprint when packaged for storage, shipping or merchandising. Optional accessories may be included with the cabinet, including a workbench type top surface, one or more shelves, one or more drawers, and one or more doors. When assembled, the cabinet is structurally stable and functional, but requires little time for complete assembly.

Referring now to FIG. 1 a fold-out cabinet 10 (also referred to as cabinet 10) can include first and second side panels 12 (also collectively referred to as side panels 12) defining opposite sides of the cabinet 10, a back panel 14 that interconnects the two side panels 12, a top panel 16 and a bottom panel 20. In some embodiments, one of more shelves 22 may be disposed inside the cabinet 10. In some embodiments, one or more doors 18 may be disposed to removably cover a front face 28 of the cabinet 10.

While the cabinet 10 appears and functions like any typical cabinet when assembled, the cabinet 10 provides for a rapid, simple assembly while being able to be packaged into a relatively small package. For example, the cabinet 10, as described in greater detail below, can be packaged in packaging that has an area (length times width) less than an area of the back panel 14 of the cabinet 10.

Figure 2:
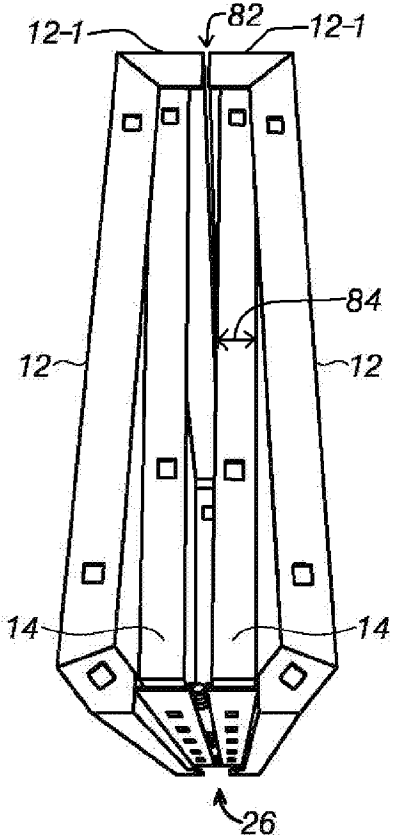
FIG. 2 shows a top view of the back and side panels of the fold-out cabinet of FIG. 1 in a folded configuration.

Referring now to FIG. 2 through FIG. 5, the cabinet 10 can be provided with the side panels 12 pivotably attached to the back panel 14. The side panels can include a bend to create back panel portions 12-1 fixed to the side panels 12. In some embodiments, the bend is a 90 degree bend to form the back panel portions 12-1. The back panel 14 can be pivotably attached to a distal end (distal of the bend) of the back panel portions 12-1. In addition, the back panel 14 can include at least one pivoting connection 26 that allows the back panel 14 to fold upon itself. The pivot axes of the side panels 12 to the back panel 14, as well as the pivot axis of the pivoting connection 26, can be substantially parallel to each other. Thus, when folded, as shown in FIG. 2, the back panel 14 can be sandwiched entirely or at least partially between the side panels 12. In some embodiments, a space 82 between the back panel portions 12-1, when the back panel 14 is sandwiched between the first and second side panels 12 in a folded configuration, is less than a thickness 84 of the back panel 14. Typically, the back panel portions 12-1 can be disposed physically contacting each other when in the folded configuration, where the back panel 14 is disposed within a cavity formed by the side panels 12 and the back panel portions 12-1.

Figure 3:
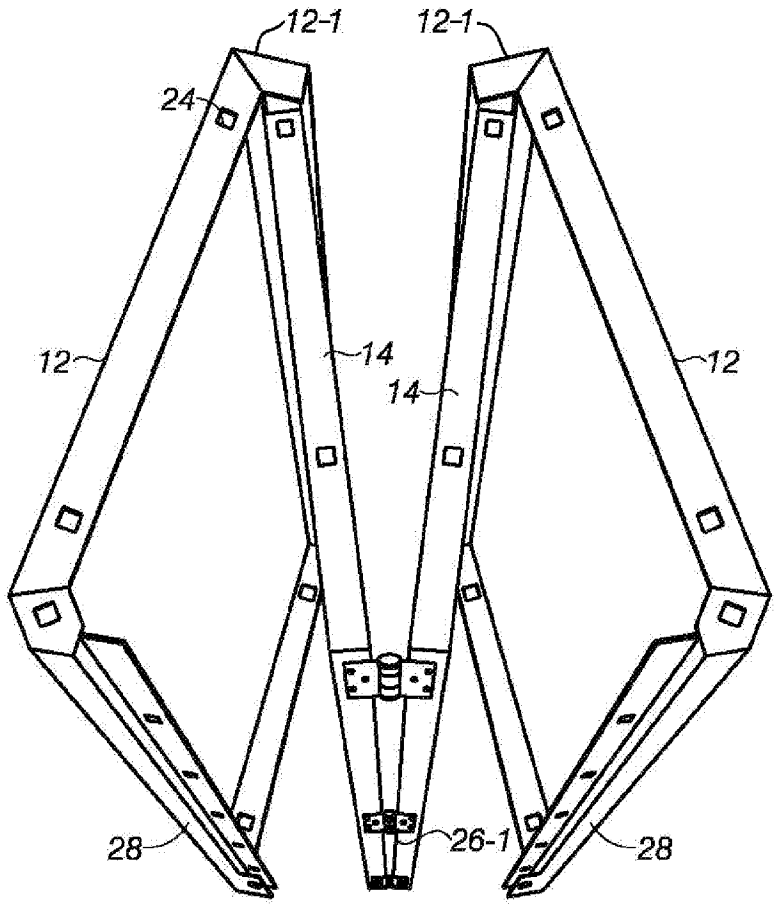
FIG. 3 shows a top view of the back and side panels of the fold-out cabinet of FIG. 1 in a partially unfolded configuration.
Figure 4A:
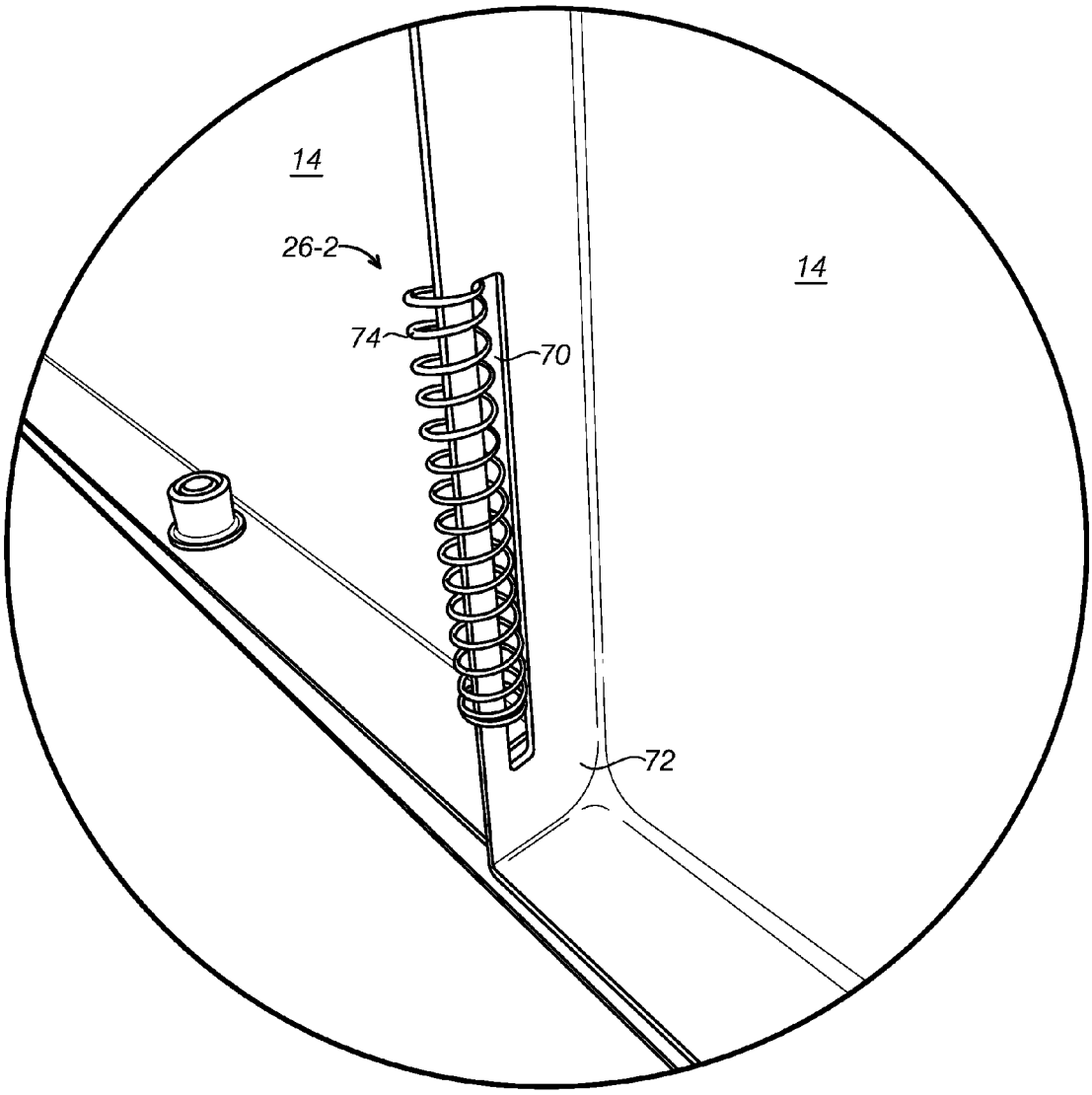
FIG. 4A shows a detailed perspective view of a back panel folding mechanism according to an exemplary embodiment of the present invention.
Figure 4B:
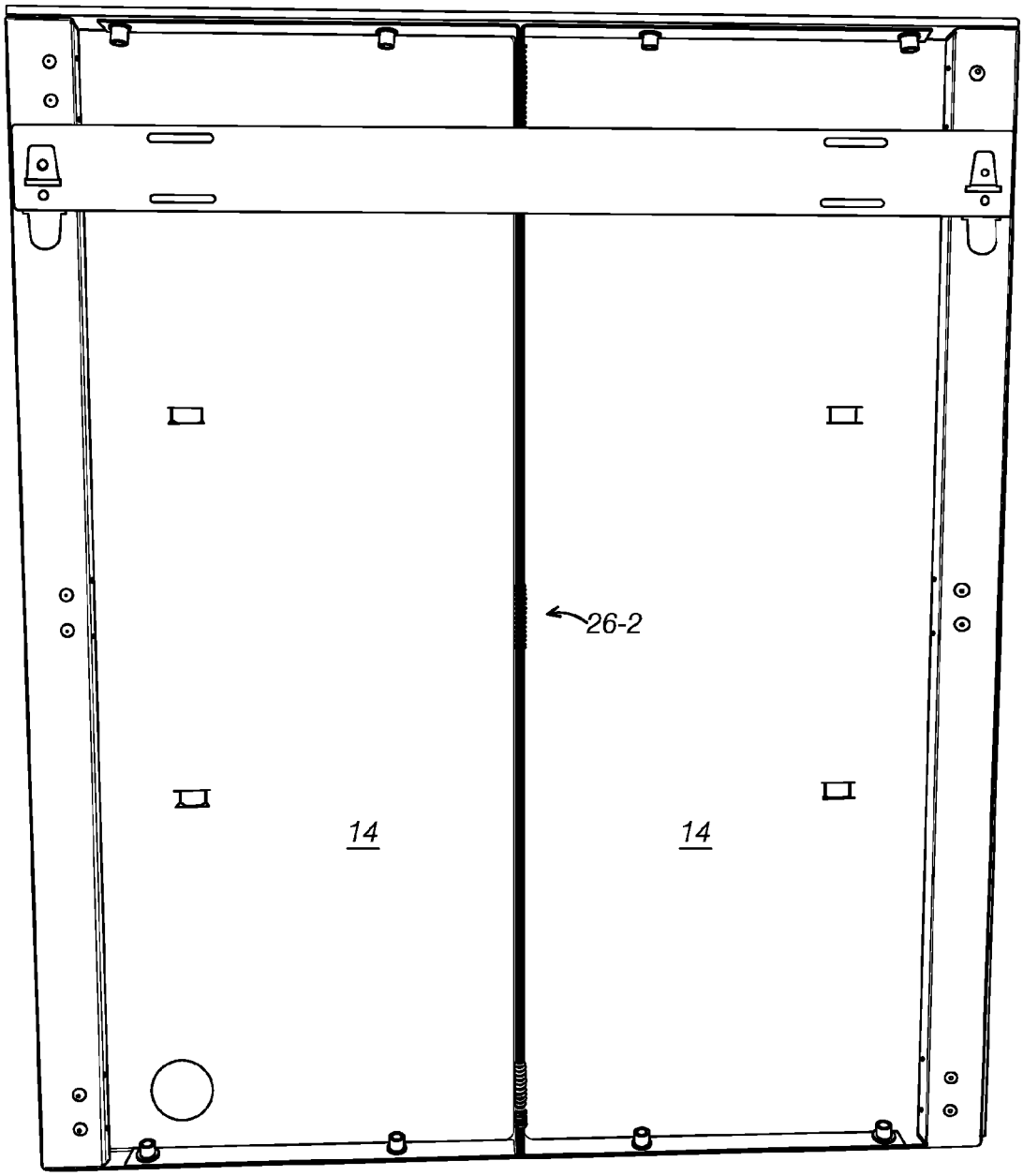
FIG. 4B shows a back view of a fold-out cabinet using the back panel folding mechanism of FIG. 4A.
Figure 5:
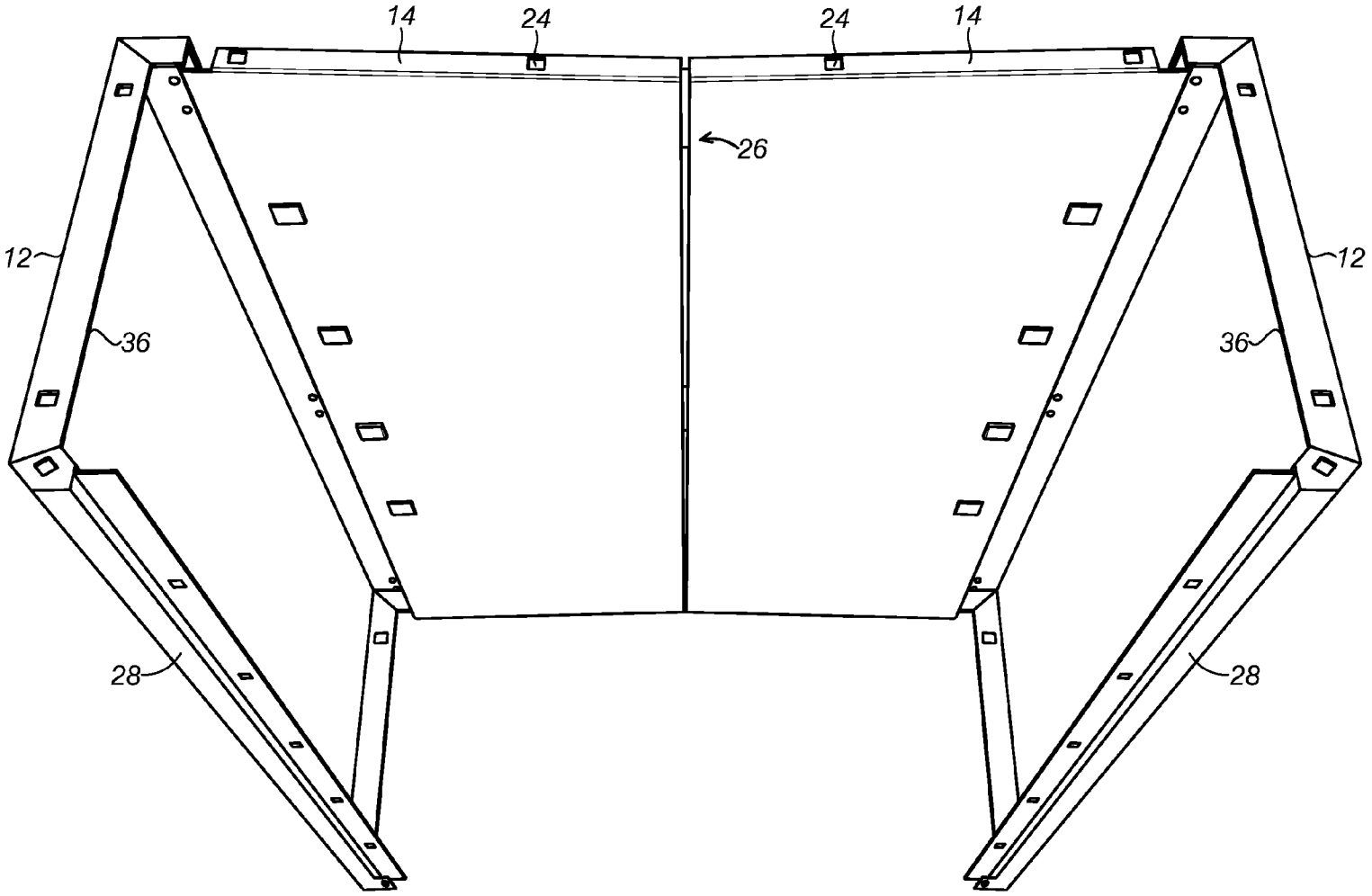
FIG. 5 shows a top perspective view of the fold-out cabinet of FIG. 1 in a fully unfolded configuration.

The pivoting connection 26 can include various connectors, such as one or more hinges 26-1, as shown in FIGS. 2 and 3, a spring clip, a piano hinge, a ball and socket, or the like. In some embodiments, as shown in FIGS. 4A and 4B, a cutout 70 may be formed in a side portion 72 of each back panel 14 such that the cutouts 70 align when the back panel 14 is fully opened (as shown in FIG. 5). A spring member 74, or other similar tubular assembly, may loop through the cutouts 70 on adjacent side portions 72 of each back panel 14. This configuration may permit the back panels 14 to fold in the same manner as with the hinge 26-1 shown in FIG. 3.

The Figures show the back panel 14 folded into two sections, thus providing a cabinet having a length (length being defined as the distance between side panels 12) of about two times the depth (the depth being the width of the side panels 12). However, in some embodiments, the cabinet of the present invention can be made in various lengths. For example, the cabinet can be made twice as long as the cabinet shown in the Figures by providing two additional pivoting connections 26 on the back panel 14. In this case, the back panel 14 will still fold to be at least partially sandwiched between the side panels 12. Thus, unlike conventional cabinetry, where the packaging must be at least as large as the back panel of the cabinet, the packaging for the cabinet of the present invention would only need to be slightly larger than the length and width of the side panel 12.

Figure 7:
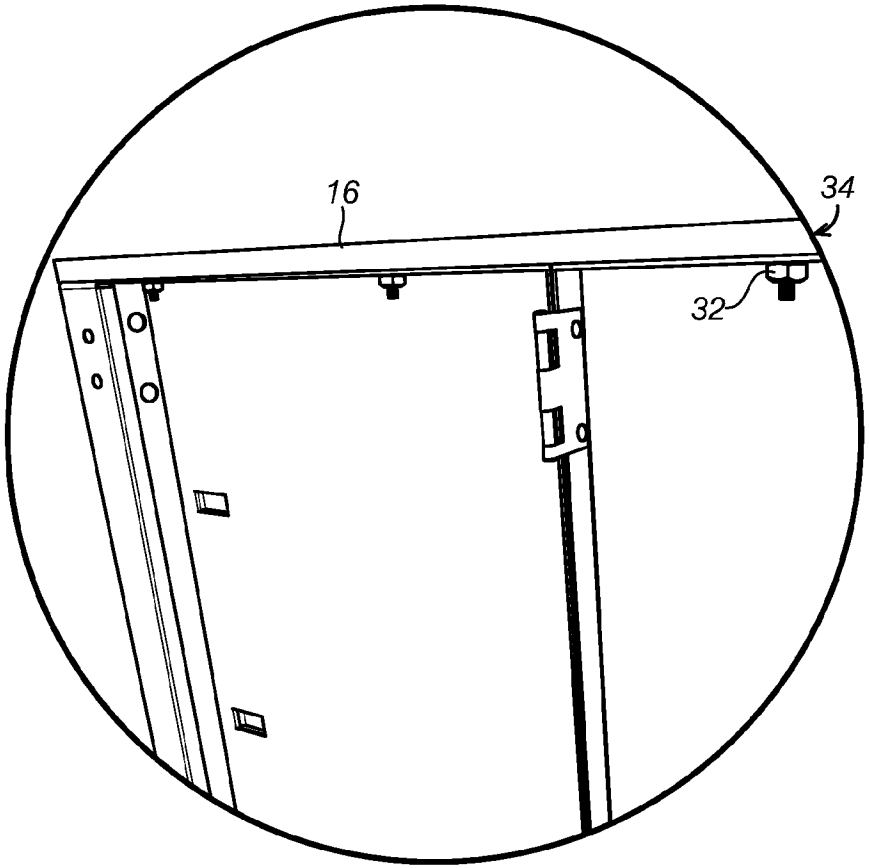
FIG. 7 shows a detailed back view of the unfolded cabinet of FIG. 6, with the top panel attached, illustrating an outward turning lip forming a recessed back panel.
Figure 6:
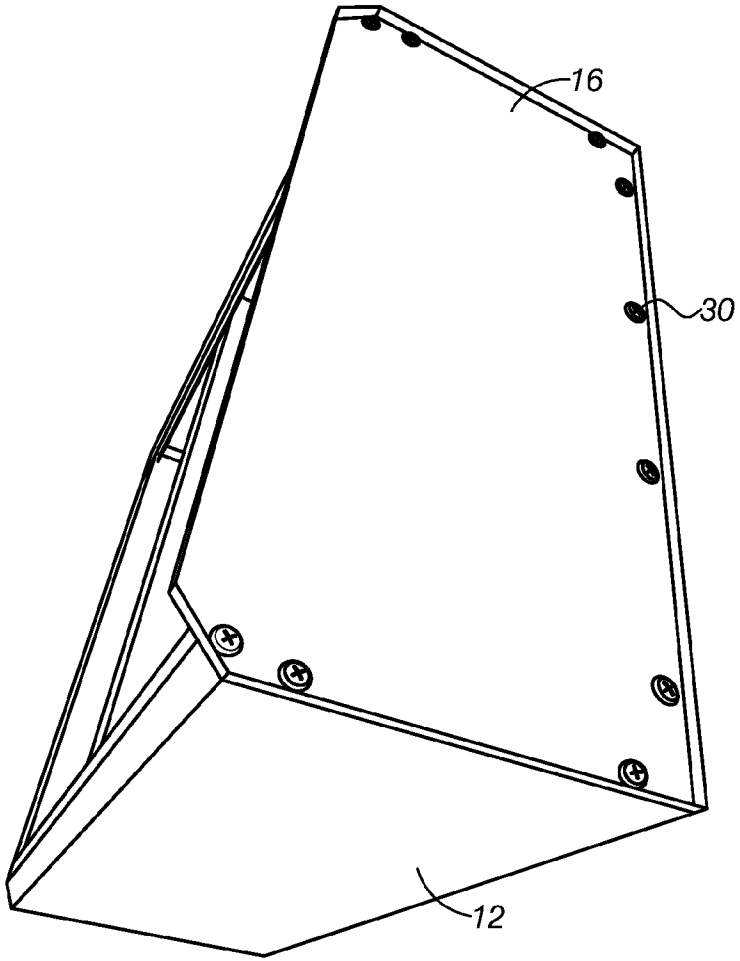
FIG. 6 shows a top perspective view of the unfolded cabinet of FIG. 5 with a top panel attached.

Referring to FIG. 5 through FIG. 7, a plurality of holes 24 can be disposed in a lip 36 formed along a top edge of the side panels 12 and a lip 34 formed along a top edge of the back panel 14. The top panel 16 can attach to the back panel 14 and the side panels 12 by passing an attachment member, such as a bolt 30, through the top panel 16 and through the holes 24. A mating attachment member, such as a nut 32, can secure the top panel 16 to the back panel 14 and the side panels 12. The lip 36 of the side panels 12 may be turned inward, so that the nuts 32 cannot be seen from viewing the exterior side of the cabinet 10. The lip 34 of the back panel 14, however, may be turned outward to form a recess in the back of the cabinet to receive the nuts 32, where the nuts are not visible when the cabinet 10 is placed against a surface, such as a wall. Of course, other configurations may be used to attach the top panel 16 to the back panel 14 and the side panels 12. For example, a twist lock member may be integrated into the top panel and a receiving member may be integrated into the back and side panels, where, when the top panel is placed on the back and side panels, the twist lock member may be turned to engage the receiving member to assemble the components.

Figure 8B:
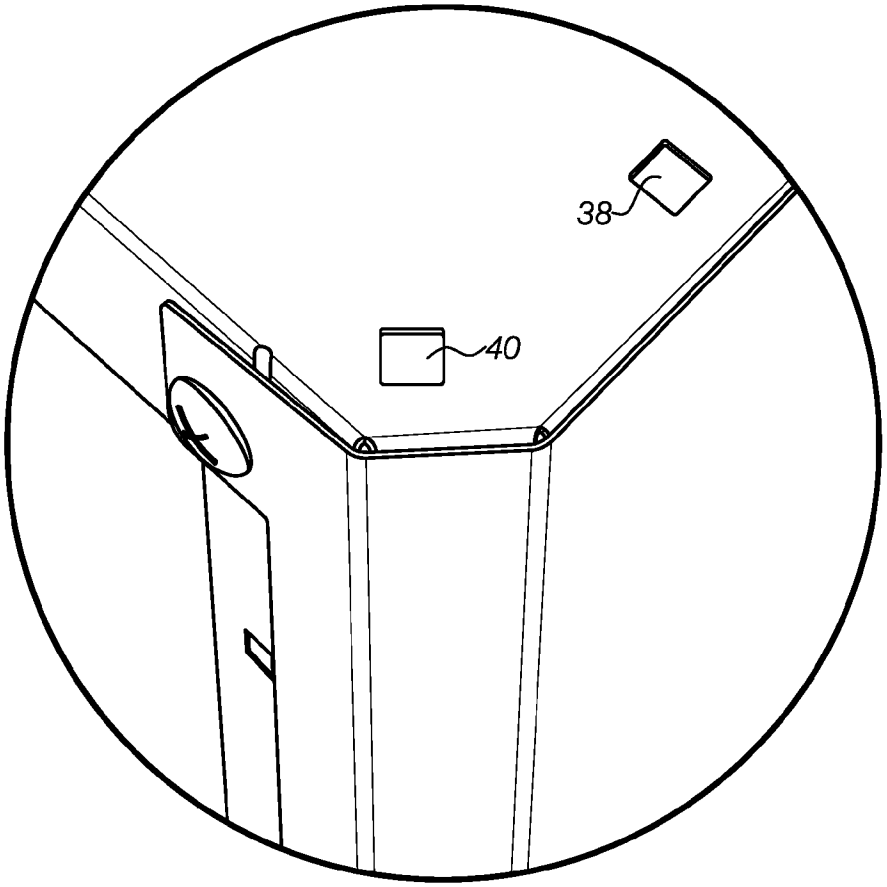
FIG. 8B shows a detailed perspective view of the mounting holes in a front corner of the fold-out cabinet.
Figure 8A:
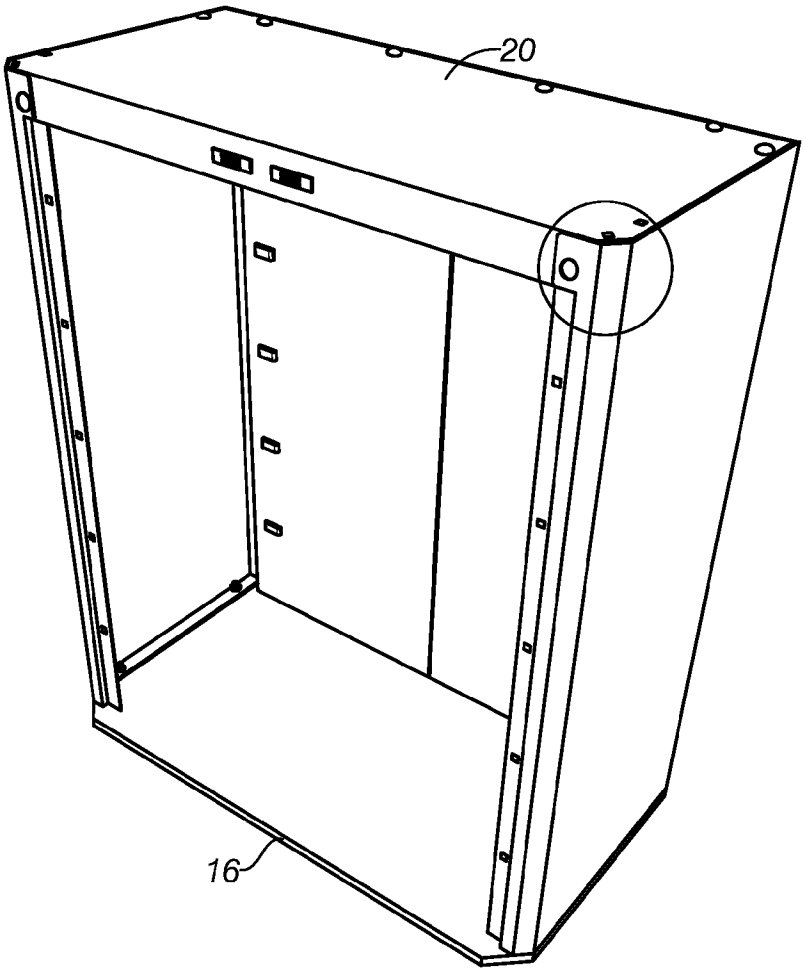
FIG. 8A shows a perspective view of the unfolded cabinet of FIG. 5, in an upside-down orientation, illustrating attachment of the bottom panel.
Figure 9A:
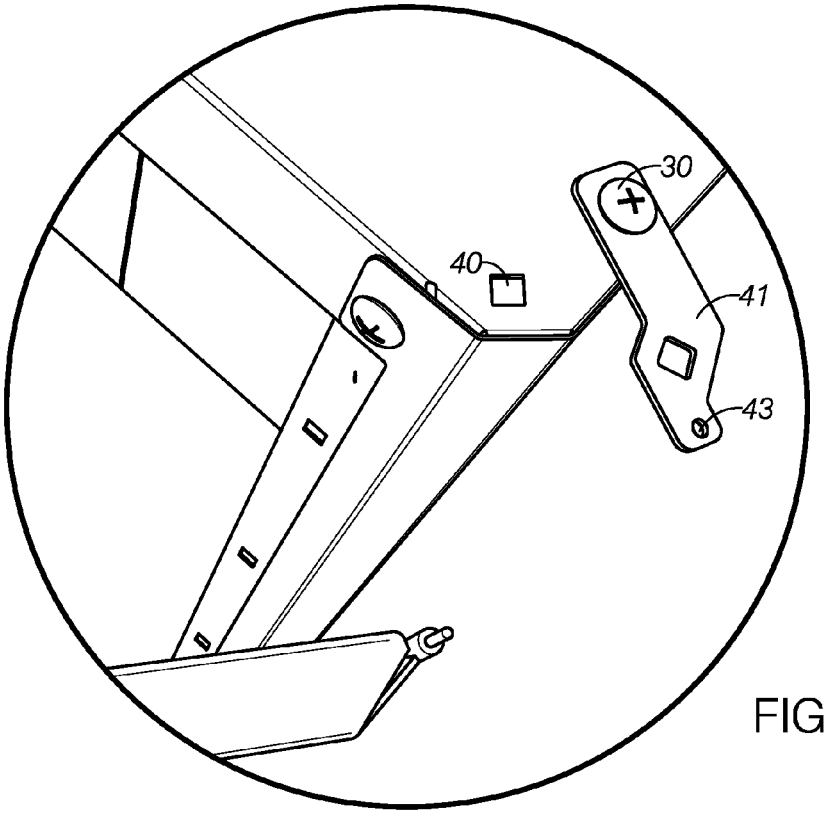
FIG. 9A shows a detailed perspective view illustrating placement of a door mounting member on the bottom panel of the fold-out cabinet.
Figure 9B:
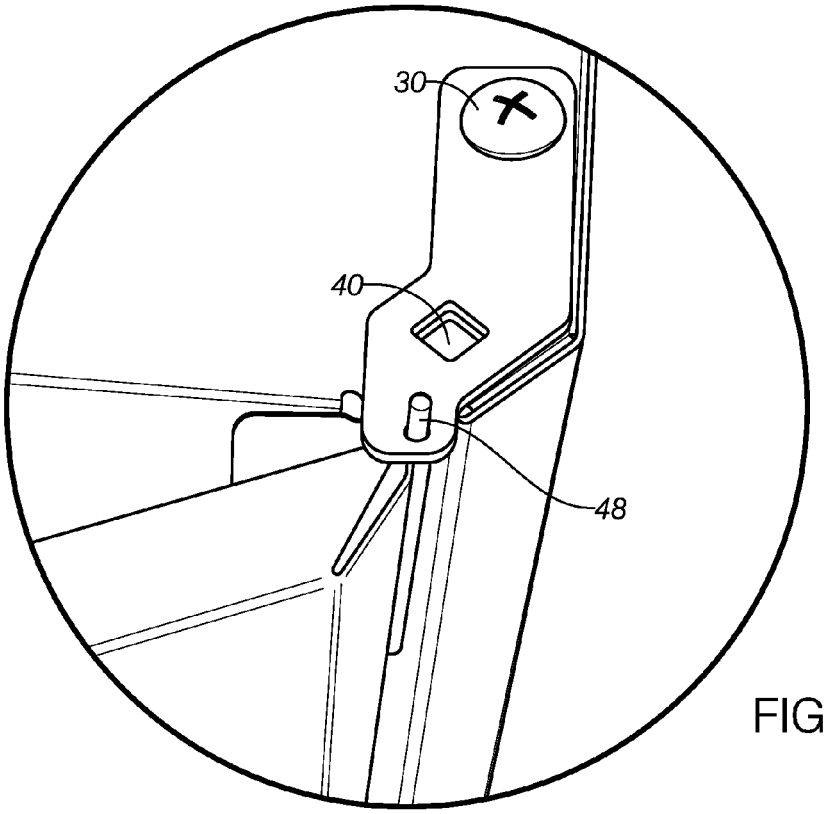
FIG. 9B shows a detailed perspective view illustrating mounting of the door on the door mounting member.

Referring to FIG. 8A and FIG. 8B, the cabinet 10 is shown upside-down, where the bottom panel 20 is attached to the sides panels 12 and the back panel 14. In an exemplary embodiment, the bottom panel 20 can include a front hole 40 and a rear hole 38. During attachment of the bottom panel 20 to the side panels 12 and the back panel 14, the front hole 40 and the rear hole 38 are kept open in anticipation of the attachment of a door 18, as described below. If a door is not to be installed, the front hole 40 and the rear hole 38 may be used to receive an attachment member, such as a bolt. Typically, the bottom panel 20 can connect to the side panels 12 and the back panel 14 in a manner similar to that which the top panel 16 attaches. However, other attachment mechanisms and methods, as may be known in the art, may be used to make this connection.

Referring to FIG. 9A through FIG. 10B, the door 18 may be attached to cover the front of the cabinet 10. In some embodiments, a single door may be used, as shown in the Figures. However, the cabinet of the present invention may use more than one door, such as two doors, swinging from each side of the cabinet, to cover the front of the cabinet 10. In some embodiments, the door may be excluded entirely, leaving the cabinet open.

Figure 10B:
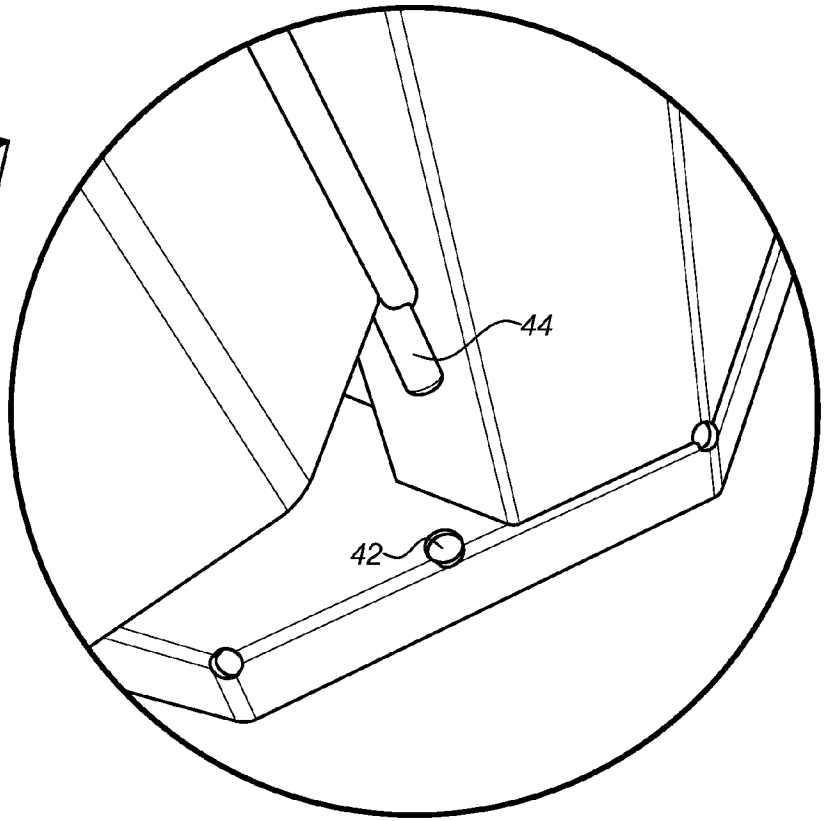
FIG. 10B shows a detailed perspective view illustrating insertion of the door pin into a hole in the top panel of the fold-out cabinet, where the cabinet is shown in an upside-down configuration.
Figure 10A:
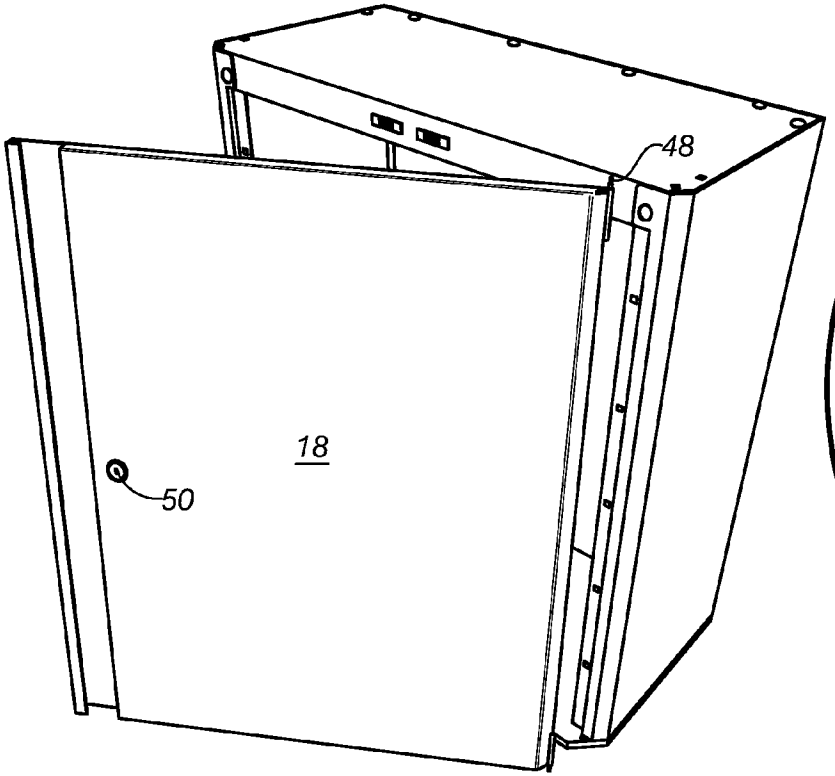
FIG. 10A shows a perspective view illustrating attachment of the door onto the door mounting member on the bottom panel and a hole in the top panel, where the cabinet is shown in an upside-down configuration.

The door 18 may include a bottom pin 48 and a top pin 44. The top pin 44 may be inserted into a hole 42 in the top panel 16, as shown in FIG. 10B. Typically, this is performed with the cabinet 10 upside-down, as shown in FIG. 10A. This results in the door 18 being attached to the top panel 16.

To attach the door 18 to the bottom panel 20, a door mounting member 41 may be first attached to the rear hole 38 of the bottom panel 20 with a bolt 30, for example. The bottom pin 48 of the door 18 may be fitted into a pin receiving hole 43 in the door mounting member 41. Once the bottom pin 48 is fitted into the pin receiving hole 43, the door mounting member 41 may be rotated to complete the mounting to the bottom panel 20 by inserting a bolt 30 through the door mounting member 41 and the front hole 40.

The door 18 may include one or more accessories, such as a handle (shown as molded into the design of the door, but could also include one or more separate handles, pulls, or the like) or a lock 50. The door 18 may attach to either side of the cabinet to provide a left-hand or a right-hand opening door.

When the cabinet is longer than that shown in the Figures, as discussed above where the back panel includes more than one pivoting connection 26, the top panel 16, bottom panel 20, and even the shelf 22 may include a top pivoting connection to permit folding of the various members. Of course, one or all of these members may still be provided as a single, solid piece.

Once the door 18 is attached, the cabinet 10 may be turned upside-up and the optional shelf 22 may be installed therewithin. The shelf 22 may attach in various manners, such as with pins, with protrusions in the side panels 12 and the back panel 14, with fasteners, or the like.

Figure 11:
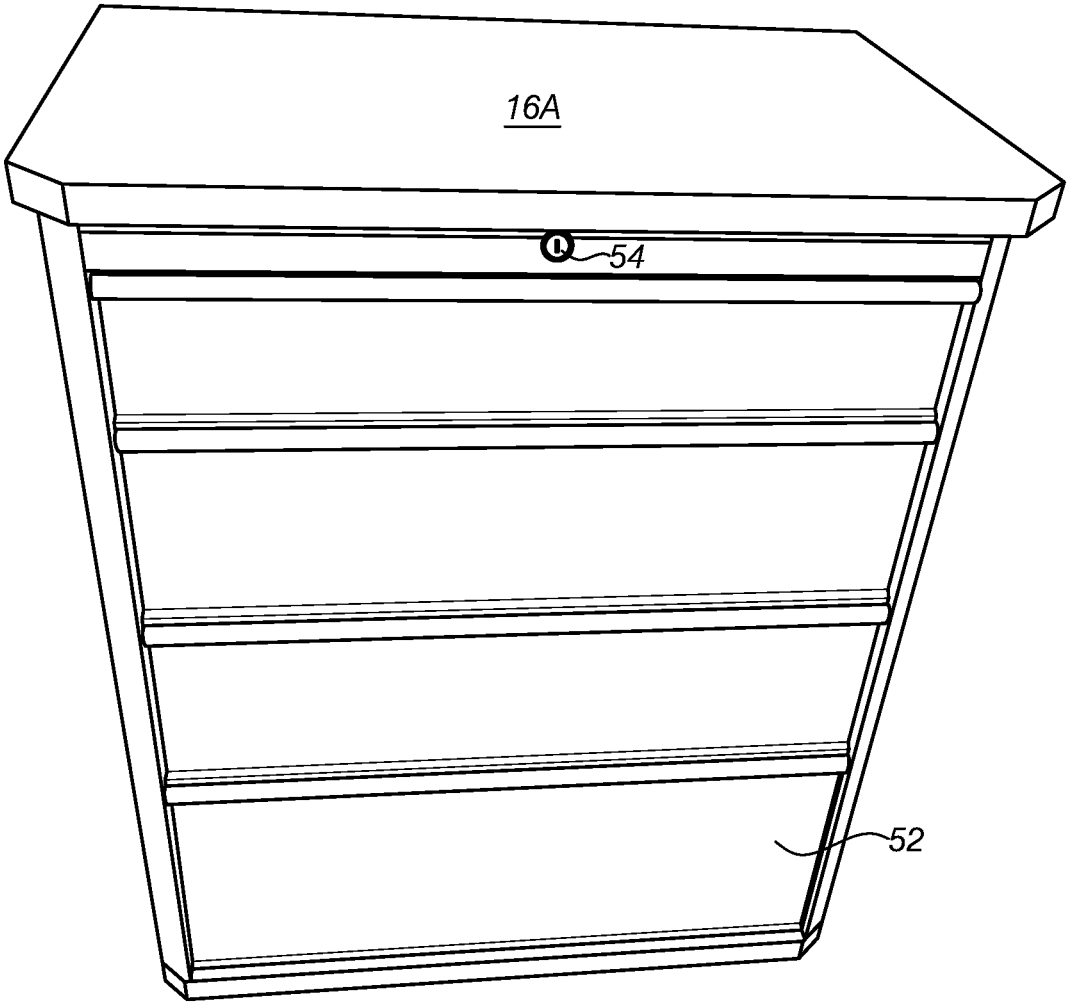
FIG. 11 shows an alternate use of the fold-out cabinet to create a set of drawers therein, according to an exemplary embodiment of the present invention.

As discussed above, the cabinet 10 may be formed to receive one or more shelves 22 or may be kept completely open. Referring to FIG. 11, in some embodiments, one or more drawers 52 may be disposed inside the cabinet 10. The drawers 52 may be disposed in a manner known in the art. For example, drawer slides may be attached to the side panels 12 to permit the drawers 52 to slide in and out of the cabinet. A lock 54 may optionally be disposed to lock one or more of the drawers 52.

FIG. 11 also shows an alternate embodiment for the top panel 16 described above. In this embodiment, a solid top panel 16A, such as a solid wood top panel, may be attached to the side panels 12 and the back panel 14 so that the attachment members (such as the bolts 30 described above) are not visible from the top panel 16A. For example, wood screws (not shown) may be used to secure the solid top panel 16A to the side panels 12 and back panel 14.

Some embodiments of the present invention include a method for assembling a cabinet, where the cabinet is unfolded, as shown from FIG. 2 to FIG. 5. More specifically, the side panels 12 can be separated to cause the back panel 14 to straighten. The side panels 12 can then be positioned at a 90 degree angle relative to the back panel 14. The top panel 16 can then be attached to the back panel 14 and the side panels 12. At this point, the cabinet may be turned upside down so that the bottom panel 20 can be easily attached to the side panels 12 and the back panel 14. At this point, the cabinet is complete and optional items may be added. These optional items can include one or more doors, one or more drawers, one or more shelves, or combinations of these items.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A fold-out cabinet comprising:

first and second side panels each formed with a bend to create first and second back panel portions fixed to the first and second side panels;

a back panel pivotably attached along first and second pivot axes at opposing ends of the back panel to each of the first and second back panel portions; and one or more pivoting connections formed in the back panel, the pivoting connections permitting the back panel to fold, wherein a space between the first and second back panel portions, when the back panel is sandwiched between the first and second side panels in a folded configuration, is less than a thickness of the back panel; and a top surface of the back panel is disposed entirely between and aligned with the first and second back panel portions in an open configuration.

2. The fold-out cabinet of claim 1, wherein the one or more pivoting connections have a pivot axis that is parallel to the first and second pivot axes.

3. The fold-out cabinet of claim 1, further comprising a top panel attached to a top edge of the first and second side panels and the back panel.

4. The fold-out cabinet of claim 3, further comprising a bottom panel attached to a bottom edge of the first and second side panels and the back panel.

5. The fold-out cabinet of claim 1, further comprising one or more doors covering a front face of the cabinet.

6. The fold-out cabinet of claim 5, wherein the door includes a top door pin, fitting into a top panel hole, and a bottom door pin, fitting into a bottom panel hole.

7. The fold-out cabinet of claim 6, wherein the bottom panel hole is a hole formed in a door mounting member attached to the bottom panel.

8. The fold-out cabinet of claim 1, further comprising one or more shelves are disposed between the first and second side panels.

9. The fold-out cabinet of claim 1, further comprising one or more drawers disposed between the first and second side panels.

10. A fold-out cabinet comprising:

first and second side panels each formed with a bend to create a first and second back panel portions fixed to the first and second side panels;

a back panel pivotably attached along first and second pivot axes at opposing ends of the back panel to each of the first and second back panel portions;

one or more pivoting connections formed in the back panel, the pivoting connections permitting the back panel to fold, the pivoting connections having a back panel pivot axis substantially parallel to the first and second pivot axes;

a top panel attached to a top edge of the first and second side panels and the back panel; and a bottom panel attached to a bottom edge of the first and second side panels and the back panel, wherein a space between the first and second back panel portions, when the back panel is sandwiched between the first and second side panels in a folded configuration, is less than a thickness of the back panel; and a top surface of the back panel is disposed entirely between and aligned with the first and second back panel portions in an open configuration.

11. The fold-out cabinet of claim 10, further comprising one or more doors covering a front face of the cabinet.

12. The fold-out cabinet of claim 11, wherein the door includes a top door pin, fitting into a top panel hole, and a bottom door pin, fitting into a bottom panel hole.

13. The fold-out cabinet of claim 10, further comprising one or more shelves are disposed between the first and second side panels.

14. The fold-out cabinet of claim 10, further comprising one or more drawers disposed between the first and second side panels.

15. A method for assembling a cabinet, comprising:

pivoting, along a first pivot axis, a first side panel to a 90 degree angle relative to a back panel;

pivoting, along a second pivot axis, a second side panel to a 90 degree angle relative to a back panel, wherein the first and second side panels are each formed with a bend to create first and second back panel portions fixed to the first and second side panels;

straightening a back panel by unfolding the back panel along a third pivot axis, wherein a top surface of the back panel is disposed entirely between and aligned with the first and second back panel portions in an open configuration;

attaching a top panel to a top edge of the first side panel, the second side panel and the back panel; and attaching a bottom panel to a bottom edge of the first side panel, the second side panel and the back panel, wherein a space between back ends of the first and second side panels, when the back panel is sandwiched between the first and second side panels in a folded configuration, is less than a thickness of the back panel.

16. The method of claim 15, further comprising attaching one or more doors to cover a front face of the cabinet.

17. The method of claim 15, further comprising positioning one or more shelves between the first and second side panels.

18. The method of claim 15, further comprising positioning one or more drawers between the first and second side panels.

19. The method of claim 15, wherein the first axis, the second axis and the third axis are substantially parallel to each other.

* * * * *